US005788369A

United States Patent [19]

Tseng

[11] Patent Number: 5,788,369

[45] Date of Patent: Aug. 4, 1998

[54] INFANT NURSING BOTTLE WITH MIXING ELEMENT

[76] Inventor: Wen-Pin Tseng, 3 Fl. 230, Sec. 1, Hwa Mei West St., Taichung, Taiwan

[21] Appl. No.: 827,988

[22] Filed: May 4, 1997

[51] Int. Cl.[6] ..... A61J 9/02

[52] U.S. Cl. ..... 366/130; 215/11.2; 215/DIG. 8

[58] Field of Search ..... 366/129, 130, 366/189, 219, 336, 347, 349; 220/568; 206/219, 221; 215/11.1, 11.2, 11.6, 228, DIG. 8

[56] References Cited

U.S. PATENT DOCUMENTS

| | | | |
|---|---|---|---|
| 1,075,119 | 10/1913 | Reichner | 366/130 X |
| 1,661,336 | 3/1928 | Katz | 220/568 X |
| 1,672,466 | 6/1928 | Oshman et al. | 215/11.1 |
| 1,748,483 | 2/1930 | Hyde | 366/130 X |
| 2,483,979 | 10/1949 | Morrill | 215/11.2 X |
| 2,500,611 | 3/1950 | Kereluck | 220/568 X |
| 2,592,485 | 4/1952 | Stair | 220/568 X |
| 2,786,769 | 3/1957 | Greenspan | 215/DIG. 8 X |
| 2,793,778 | 5/1957 | Maxwell | 215/11.1 |
| 3,125,984 | 3/1964 | Okuyama | 215/11.2 X |
| 4,818,114 | 4/1989 | Ghavi | 366/130 |
| 4,915,242 | 4/1990 | Marte | 215/DIG. 8 X |
| 4,919,983 | 4/1990 | Fremin | 215/11.2 X |
| 5,044,509 | 9/1991 | Petrosky . | |
| 5,145,077 | 9/1992 | Rohrig . | |
| 5,542,922 | 8/1996 | Petterson et al. | 215/11.1 X |

FOREIGN PATENT DOCUMENTS

| | | | |
|---|---|---|---|
| 1124286 | 10/1956 | France | 215/11.1 |
| 3836424 | 7/1989 | Germany | 215/11.2 |

*Primary Examiner*—Charles E. Cooley

*Attorney, Agent, or Firm*—David & Raymond; Raymond Y. Chan

[57] ABSTRACT

An infant nursing bottle includes a bottle body, a nipple and an affixing ring, in which the bottle body has an enlarged bottle opening and a stirring fin protruded inwardly form a surrounding wall or a bottle base thereof for enhancing the mixing between the drinkable water and milk powder by hand shaking of the infant nursing bottle in any and all directions. The infant nursing bottle further includes a mixing element mounted on the affixing ring for further enhancing the mixing effect. On the surface of the bottle body, a heat detecting figure is painted thereon which would change color at a predetermined temperature. Therefore, the heat detecting figure would change color as soon as the milk or drinkable liquid in the infant nursing bottle has exceeded the temperature that is suitable for the infant to consume, so as to give a warning signal to the parents to prevent the infant from getting burned while consuming the milk.

12 Claims, 4 Drawing Sheets

INFANT NURSING BOTTLE WITH MIXING ELEMENT

FIELD OF THE PRESENT INVENTION

The present invention relates to an infant nursing bottle, and more particularly to a nursing bottle with mixing element to enable the parents easily and completely mixing the milk powder with drinkable water in the nursing bottle for the infant to consume, which further includes a temperature sensing device for detecting the milk temperature for ensuring that the milk is at the right temperature for the infant.

BACKGROUND OF THE PRESENT INVENTION

The conventional infant nursing bottle which is used to mix the milk powder with the drinkable water therein for the infant to consume, comprises a bottle body having an opening and screw threads at an upper end of the infant nursing bottle, a nipple disposed on the opening, an affixing ring for fastening the nipple to cover the opening of the bottle body, and a nipple cover provided for covering the nipple. For preparing milk with such conventional infant nursing bottle, first, add certain amount of drinkable water into the bottle body, and then add the milk powder and, if necessary, other infant nutrition food powder into the bottle body through the opening thereof for mixing with the drinkable water therein. Finally, fasten the nipple with the affixing ring and hand shake the infant nursing bottle in any direction until the drinkable water, the milk powder and other infant nutrition food powder are totally mixed. The milk powder and the nutrition powder will be dissolved in the drinkable water to form the drinkable milk.

However, the conventional infant nursing bottle has the following shortcomings due to the defectives of design.

1. Normally, the milk powder or the infant nutrition food powder within the bottle body will not dissolve in the drinkable water immediately. Since the surrounding walls of the bottle body and bottle base are all smooth surfaces, even though the parent continuously shakes the infant nursing bottle in every possible direction, the milk powder still can not totally and evenly dissolve in the drinkable water. Thus, some undissolved milk particles may form and precipitate within the infant nursing bottle. During the infant consumption stage, the undissolved milk particles may affect the free flow of the liquid milk out of the nipple of the infant nursing bottle, and in the worst case, such undissolved milk particles may even clog the outlet of the nipple and seriously affect the infant's consumption.

2. Even if the outlet of the nipple of the infant nursing bottle is not clogged and the infant is able to drink all the milk; the undissolved milk particles, which are still left in the infant nursing bottle, not only increase the degree of difficulty during cleaning and washing, but also unnecessarily waste the milk powder.

3. Each kind of the conventional infant nursing bottle provides a bottle opening having the same size as the scoop used to add the milk powder into the infant nursing bottle, such as the nursing bottle disclosed in U.S. Pat. No. 5,044,509, so that most scoops suffer the difficulty of toppling over the milk powder into the infant nursing bottle. Instead, most of the milk powder would be spilt outside of the infant nursing bottle, that will cause unnecessary waste and also is very troublesome to clean up. Although there are new infant nursing bottles providing enlarged bottle opening, such as the U.S. Pat. No. 5,145,077, such conventional product which has an enlarged bottle opening also requires an enlarged nipple base portion to be affixed by an enlarged affixing ring for fitting the enlarged bottle opening on the upper end of the infant nursing bottle. However, the use of the enlarged nipple base portion of the nipple will also decrease the rigidity of the nipple in proportion to the increased size of the nipple base portion. In other words, as the nipple base portion is enlarged, the supporting ability of the nipple decreases. Therefore, when the infant is sucking the milk out of the infant nursing bottle, the nipple may fall into the infant nursing bottle, and thus the milk would spill all over.

4. Still another shortcoming is that most of the conventional infant nursing bottles do not provide any heat checking ability. During the milk powder mixing process, the parent has to spend a lot of time trying to control the temperature of the milk to fit for the infant to consume. The parent usually can not adjust the right temperature on the first try that the temperature usually is either too hot or too cold for the infant to consume. This problem especially stands out during night time when the parent is sleepy. If the adequate temperature is not obtained, the infant may get burned during consumption.

Recently, manufacturers design an infant nursing bottle with a heat sensing device, but such electronic heat sensing device contains complicate configuration and too many components which relatively increase the production cost and result an unaffortable sale price to the consumer. Furthermore, the heat sensing device as mentioned above is constructed by electronic components which may have the electrical leakage occurred during usage. Moreover, the heat sensing device is installed at a lower position near the base of the bottle that contradicts and violates a physical phenomenon of that "hotter liquid would rise to top and cooler liquid would drop to bottom". Therefore, the heat sensing device can only detect the temperature of the lower portion of the milk within the infant nursing bottle, when, in fact, the upper portion of the milk may contain hotter milk that is not suitable for the infant to consume. In other words, the heat sensing device can not detect the true temperature of the milk in the infant nursing bottle. It is the major reason of why the market still does not provide any infant nursing bottle with the heat sensing device.

SUMMARY OF THE PRESENT INVENTION

The main objective of the present invention is to provide an infant nursing bottle having an enlarged bottle opening, in which at least a stirring fin is inwardly protruded from the surrounding walls or the bottle base of the bottle body for enhancing the mixing effect of the drinkable water with the milk powder and/or other infant nutrition food powder by hand shaking the infant nursing bottle in any direction. The milk powder, the infant nutrition food powder and the drinkable water can be fully and well mixed by the friction between the stirring fin of the infant nursing bottle and the powder particles, so that the conventional problem of milk particles precipitated within the bottle can thus be eliminated.

Another objective of the present invention is to provide an infant nursing bottle which comprises an affixing ring which top end provides an inner threaded portion for securing a mixing element which not only can well support a nipple but also can further enhance the mixing effect of the drinking water with the milk powder while hand shaking the infant nursing bottle.

Still another objective of the present invention is to provided an infant nursing bottle which bottle body has an exterior surface provided with a heat detecting figure printed by heat detecting paint which would change color under a predetermined temperature of heat. The figure can be a decorating drawing, a wording, or a graduation. Therefore, once the milk inside the infant nursing bottle exceeds a predetermined temperature, the heat detecting figure would change color instantly as a warning signal to prevent the infant from getting burned while consuming the milk.

DETAILED DESCRIPTION OF THE PREFERRED EMBODIMENT

Figure 1:
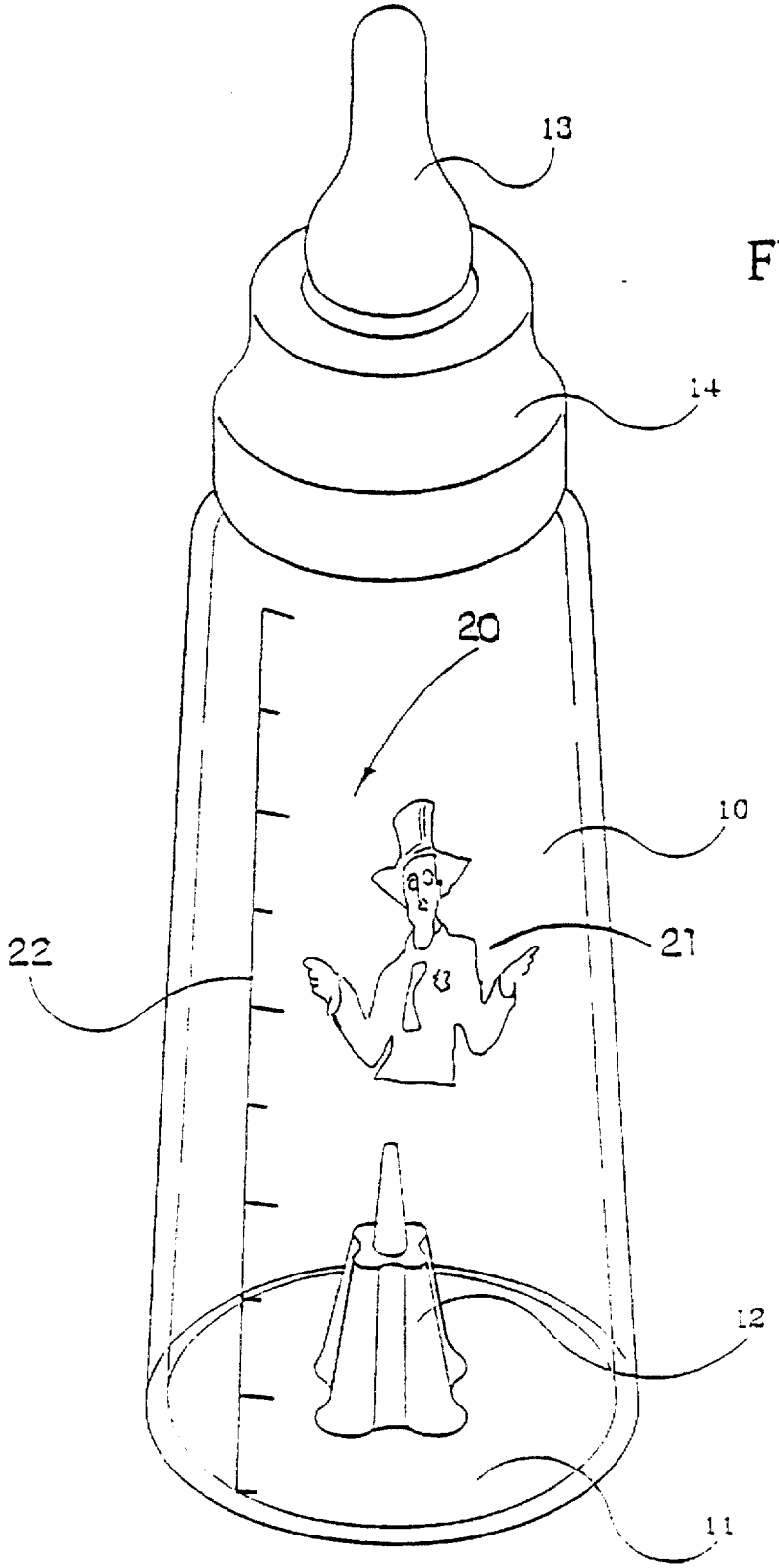
FIG. 1 is a perspective view of a first preferred embodiment according to the present invention.
Figure 4:
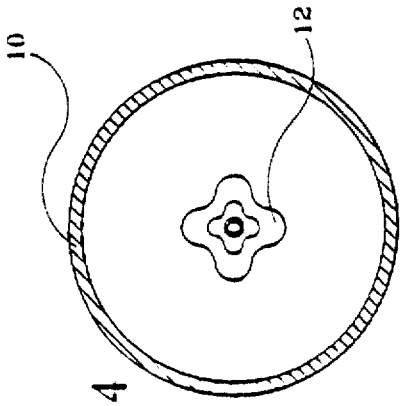
FIG. 4 is a bottom view of the above first preferred embodiment according to the present invention.

Referring to FIG. 1 to FIG. 6 of the drawings, the infant nursing bottle according to a first preferred embodiment is illustrated, which comprises a bottle body 10 in which an upper end 15 thereof provides a bottle opening 151 which has a larger diameter than the bottle opening of the conventional infant nursing bottle, a nipple 13 having the same shape and diameter as the conventional nipple on sale in the market today, an affixing ring 14 having an upper ring body 14*a* and a lower ring body 14*b* which have two different diameter sizes and are integrally and inclindedly connected together.

Figure 5:
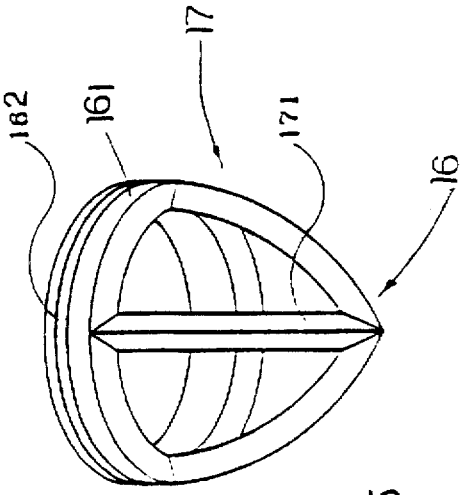
FIG. 5 is a perspective view of the mixing element of the above first preferred embodiment according to the present invention.
Figure 3:
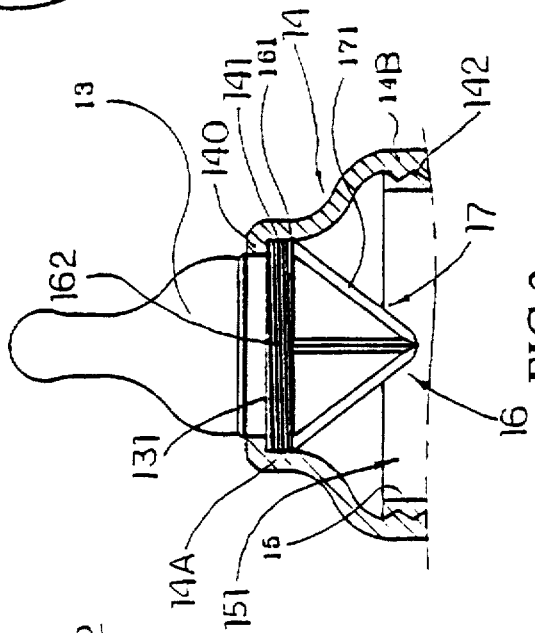
FIG. 3 is a partially sectional view of the above first preferred embodiment of the present invention, illustrating a nipple secured by a mixing element on top of an affixing ring.
Figure 2:
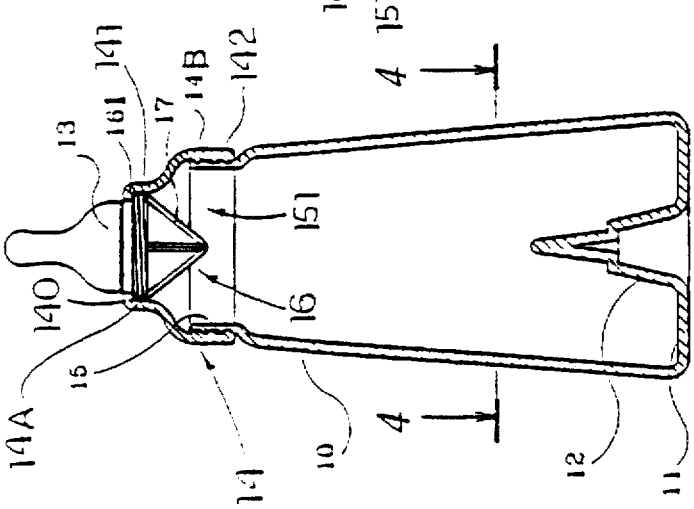
FIG. 2 is a sectional view of the above first preferred embodiment according to the present invention.

As shown in FIG. 3, the upper ring body 14*a* which has a smaller diameter provides a top rim shoulder 140 adapted for retaining a bottom rim 131 of the nipple 13, and an upper securing means 141. The lower ring body 14*b* which has a larger diameter provides an inner lower threaded portion 142 adapted for directly screwing with an outer threaded portion of an upper end 15 of the bottle body 10. A mixing element 16 comprises a fastening ring 161 fittedly engaged with the upper securing means 141 of the affixing ring 14 to press on the bottom rim 131 of the nipple 13 for securing and supporting the nipple 13 in position, and a plurality of stirring ribs 171 extended downwardly and inwardly from the fastening ring 161 to form a reverse cone shaped stirring body 17 for providing stirring and mixing effect, as shown in FIGS. 3 and 5. The mixing element 16 can ensure that, during the up and down or swinging movement of the mixing process, the milk powder and other infant nutrition food powder can entirely mix with the drinkable water easily and promptly so as to avoid any residual undissovled milk particle that may clog the nipple 13.

According to the present first embodiment, the upper securing means 141 of the affixing ring 14 is an upper threaded portion provided on an inner surface of the upper ring body 14*a* and the fastening ring 161 incorporatedly provides an outer threaded portion 162 to screw with the upper threaded portion, i.e. the upper securing means 141, of the affixing ring 14.

Furthermore, as shown in FIG. 1 of the drawing, an exterior surface of the bottle body 10 provides a heat detecting figure 20 which includes a decorative drawing or wording 21 and a graduation 22 printed by a heating detecting paint which would change color at a predetermined temperature. In other words, the heat detecting figure 20 will not change color when the liquid milk within the infant nursing bottle is suitable for the infant to consume. When the parent is mixing the milk powder with the drinkable water, the parent can easily control the milk under a temperature that is adequate for the infant to consume by observing the color change of the heat detecting figure 20. Therefore, the parents need not worry about their infant getting burned by the overheated milk.

Figure 6:
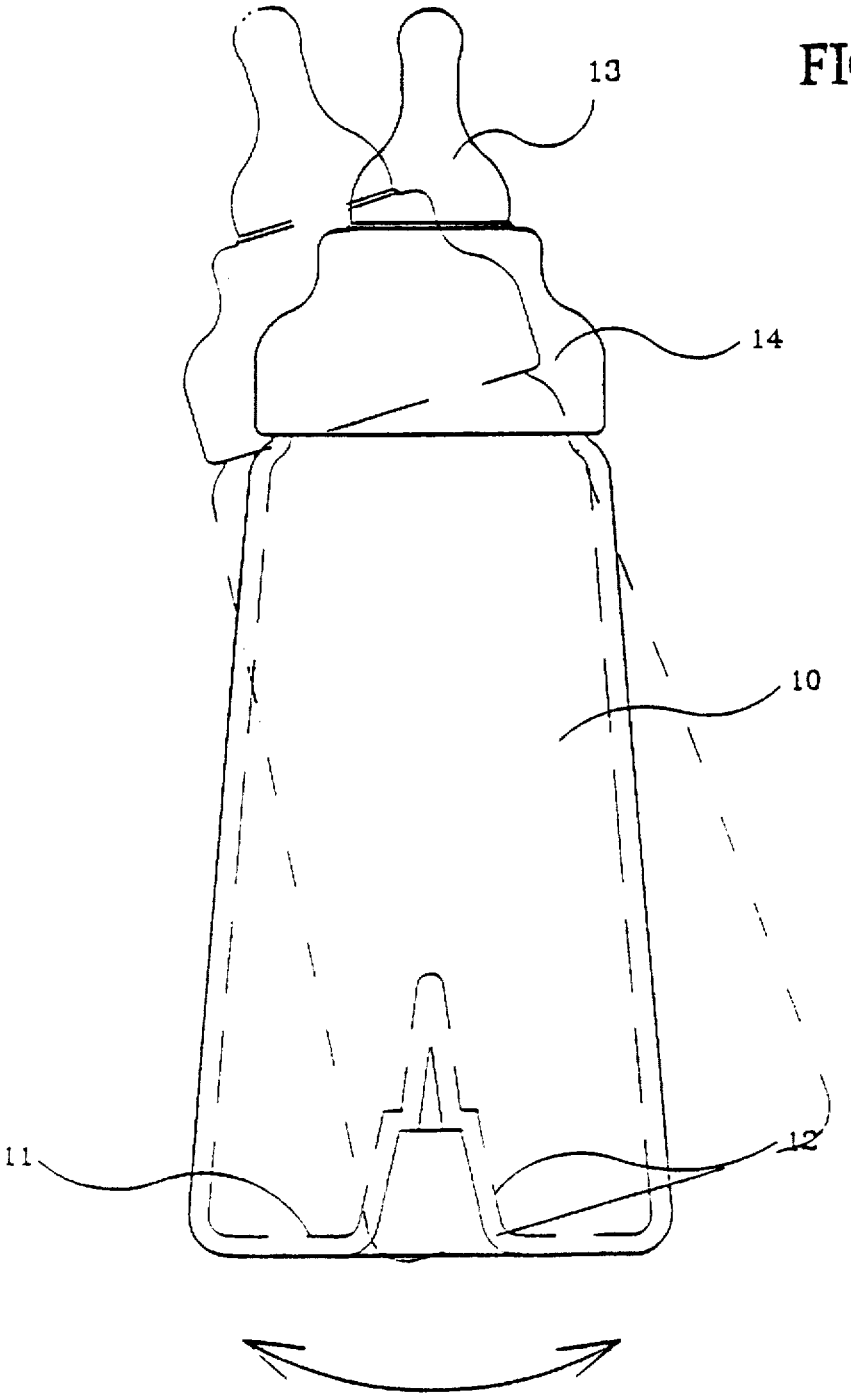
FIG. 6 is front view of the above first preferred embodiment according to the present invention, illustrating the mixing motion of the infant nursing bottle.

According to the above disclosed structure of the infant nursing bottle, the parents can firstly add a predetermined amont of the drinkable water into the infant nursing bottle, and then add an adequate amont of the milk powder into the same infant nursing bottle. In order to mix the milk powder with the drinkable water by hand shaking the infant nursing bottle in any or all directions, as shown in FIG. 6, the mixing element 16 which is extended downwardly from the bottle opening 15 within the infant nursing bottle provides a stirring effect for enhancing the mixing of the milk powder with the drinkable water, that just likes a spoon stirring the water in a cup. The milk powder can quickly and completely be mixed and dissolved in the drinking water within the infant nursing bottle. The conventional problem of leaving the residual undissovled milk particles in the infant nursing bottle is thus solved.

Furthermore, at least a stirring fin 12 is inwardly protruded from the surrounding walls or the bottle base of the bottle body for enhancing the mixing effect of the drinkable water with the milk powder and/or other infant nutrition food powder by hand shaking the infant nursing bottle in any direction. In accordance with the present preferred embodiment, the stirring fin 12 is a conical bar or rib integrally protruded from a bottle base 11 of the bottle body 10 and has a height of at least 8 cm. Certainly, the stirring fin 12 can be made in multi-sides or multi-edges cylindrical shape. Moreover it is not limited to only be protruded from the bottle base 11 of the bottle body 10. It can also be protruded at any height along the surrounding wall of the bottle body 10.

It is obvious to a person skilled in art to modify the present embodiment by providing a plurality of stirring fins 12 spacedly and integrally protruded from the surrounding walls and the bottle base 11 inside the bottle body 10 to further enhance the stirring and mixing effect.

Referring to FIG. 7 to FIG. 10, a second preferred embodiment of the present invention is illustrated, which also comprises a bottle body 10' having a bottle opening 151, a stirring fin 12' protruded form a bottle base 11' of the bottle body 10', and a nipple 13' which has the identical configuration as the above first embodiment. The infant nursing bottle of this second embodiment illustrates an alternative mode of the affixing ring 14' and the mixing element 16' respectively.

The affixing ring 14' also comprises an upper ring body 14a' and a lower ring body 14b' which has an inner threaded portion 142' for screwing with a threaded upper end 15' of the bottle body 10'. However, the upper ring body 14a' provides an upper securing means 141' which is a supporting rim inwardly protruded from an inner surface of the upper ring body 14a to define an engaging groove 143' between the supporting rim 141' and the top rim shoulder 140' for receiving a bottom rim 131' of the nipple 13'.

Figure 9:
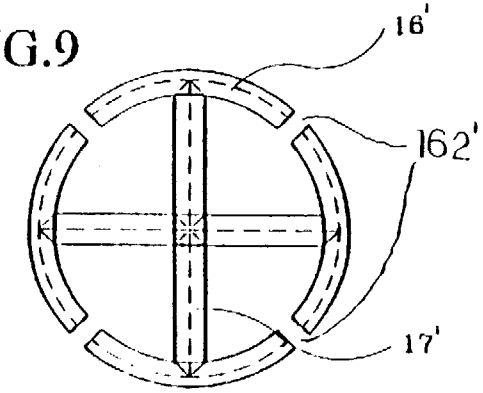
FIG. 9 is a plan view of the mixing element of the above second preferred embodiment according to the present invention.
Figure 10:
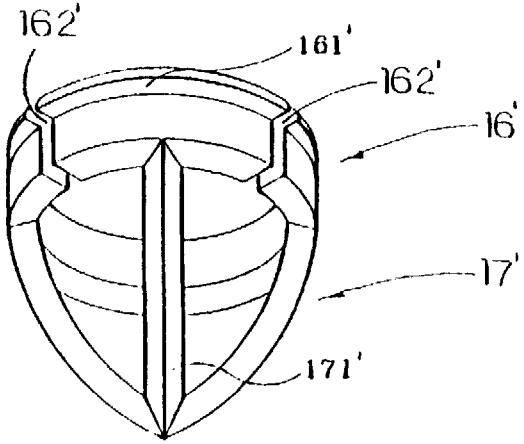
FIG. 10 is a perspective view of the mixing element of the above second preferred embodiment according to the present invention.
Figure 8:
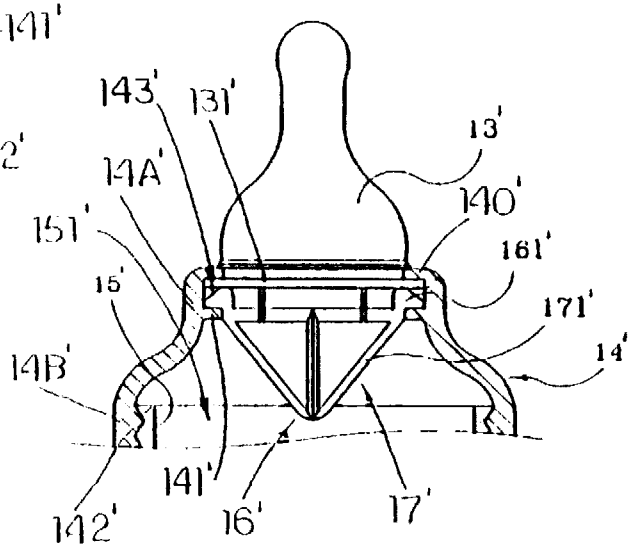
FIG. 8 is a partially sectional view of the above second preferred embodiment of the present invention, illustrating a nipple secured by an alternative mode of the mixing element on top of the affixing ring.
Figure 7:
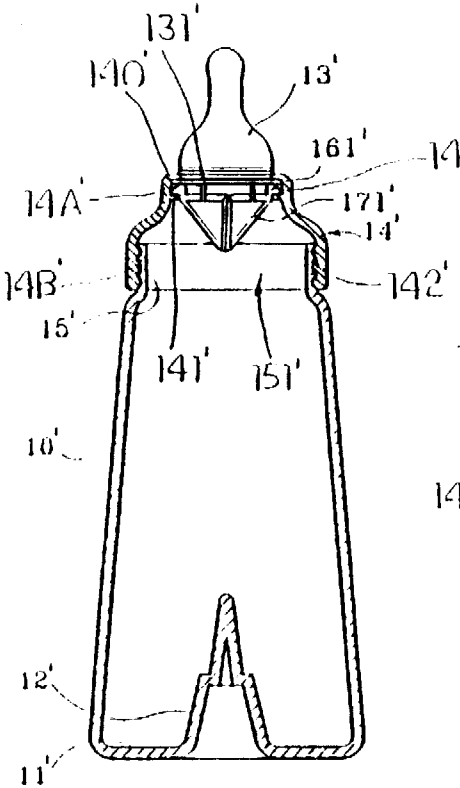
FIG. 7 is a sectional view of a second preferred embodiment according to the present invention.

The mixing element 16' comprises a fastening ring 161' and a plurality of stirring ribs 171' extended downwardly and inwardly from the fastening ring 161' to form a reverse cone shaped stirring body 17', wherein a plurality of slits 162' are spacedly formed on the fastening ring 161', as shown in FIG. 9 and 10, in order to provide an elastic ability for the fastening ring 161'. The fastening ring 161' has an outer diameter slightly larger than an inner diameter of the engaging groove of the affixing ring 14', so that the fastening ring 161' can be tightly received within the engaging groove for pressing the bottom rim 131' of the nipple 13' so as to firmly support the nipple 13' in position. Accordingly, the mixing element 17' also provides the function of stirring and mixing the milk powder with the drinkable water like the above first embodiment.

Accordingly, after comparing the function of the present invention with the conventional infant nursing bottle, one can find at least the following advantages:

1. Since the innovative design of the mixing element provided between the bottle opening and the nipple, the drinkable water, milk powder, and/or other infant nutrition food powder can be easily and completely mixed within the infant nursing bottle simply by hand shaking the infant nursing bottle in any direction. The residual milk particles precipitated within the bottle body can thus be eliminated. Therefore, the infant can more easily consume the milk without the worry of the nipple being clogged by the milk particle.
2. Because the present invention can easily and completely mixed the drinkable water, the milk powder, and/or other infant nutrition food powder, no undissolved powder particle would be left in the infant nursing bottle after the infant has finished consuming from the infant nursing bottle, so that the cleaning process is as simple as just rinsing off with water. It not only saves time but also eliminates the scrapping of the inner wall of the infant nursing bottle. Moreover, no milk powder or infant nutrition food powder will be left unconsumed that eliminates the unnecessary waste of food.
3. With the enlarged bottle opening, the parent can more easily scoop the milk powder and/or other infant nutrition food powder into the bottle body, in which no powder would spill outside of the infant nursing bottle.
4. When the milk temperature in the infant nursing bottle is over the consumable temperature for the infant, the heat detecting figure painted on the outside surface of the bottle body would change color to remind and give warning to the parent, so as to prevent the infant getting burned by consuming the overheated milk.
5. The structural components equipped for constructing the present invention are simple enough, and the material, molding and production cost are all considerably low, that is adapted for mass production. The final production cost of the present invention would not exceed the cost of manufacturing the conventional infant nursing bottle. With the new function of the present invention improved over the conventional infant nursing bottle, it makes the present invention extremely competitive in the market.

What is claimed is:

1. An infant nursing bottle, comprising:

a bottle body having an upper end provided with an enlarged bottle opening;

a nipple having a bottom rim;

an affixing ring comprising an upper ring body and a lower ring body integrally extended downwardly and inclindedly from said upper ring body, said upper ring body which has a diameter smaller than a diameter of said lower ring body providing a top rim shoulder to retain said bottom rim of said nipple thereunder, said lower ring body having an inner lower threaded portion to directly screw with an outer threaded portion of said upper end of said bottle body, said upper ring body further providing an upper securing means which is an upper threaded portion provided on an inner surface of said upper ring body; and a mixing element comprising a fastening ring fittedly engaged with said securing means of said affixing ring for pressing on said bottom rim of said nipple for securing and supporting said nipple in position, wherein said fastening ring provides an outer threaded portion to screw with said upper threaded portion of said affixing ring, said mixing element further comprising a stirring body extended downwardly from said fastening ring for providing a stirring and mixing effect.

2. An infant nursing bottle, as recited in claim 1, wherein said stirring body comprises a plurality of stirring ribs extended downwardly and inwardly from said fastening ring.

3. An infant nursing bottle, as recited in claim 2, furthering comprising a stirring fin integrally and inwardly protruded from an interior surface of said bottle body.

4. An infant nursing bottle, as recited in claim 3, wherein an exterior surface of said bottle body provides a heat detecting figure printed by a heating detecting paint which changes color at a predetermined temperature.

5. An infant nursing bottle, as recited in claim 2, furthering comprising a stirring fin which comprises a protruding bar integrally protruded from a bottle base of said bottle body.

6. An infant nursing bottle, as recited in claim 5, wherein an exterior surface of said bottle body provides a heat detecting figure printed by a heating detecting paint which changes color at a predetermined temperature.

7. An infant nursing bottle, comprising:

a bottle body having an upper end provided with an enlarged bottle opening;

a nipple having a bottom rim;

an affixing ring comprising an upper ring body and a lower ring body integrally extended downwardly and inclindedly from said upper ring body, said upper ring body which has a diameter smaller than a diameter of said lower ring body providing a top rim shoulder to retain said bottom rim of said nipple thereunder, said lower ring body having an inner lower threaded portion to directly screw with an outer threaded portion of said upper end of said bottle body, said upper ring body further providing an upper securing means which is a supporting rim inwardly protruded from an inner surface of said upper ring body to define an engaging groove between said supporting rim and said top rim shoulder to receive said bottom rim of said nipple; and a mixing element comprising a fastening ring fittedly engaged with said securing means of said affixing ring for pressing on said bottom rim of said nipple for securing and supporting said nipple in position, wherein said fastening ring provides at least a slit thereon in order to provide an elastic ability for said fastening ring, and that said engaging groove of said affixing ring has an inner diameter slightly smaller than an outer diameter of said fastening ring so as to tightly receive said fastening ring within said engaging groove for pressing said bottom rim of said nipple in order to firmly support said nipple in position, said mixing element further comprising a stirring body extended downwardly from said fastening ring for providing a stirring and mixing effect.

8. An infant nursing bottle, as recited in claim 7, wherein said stirring body comprises a plurality of stirring ribs extended downwardly and inwardly from said fastening ring.

9. An infant nursing bottle, as recited in claim 8, furthering comprising a stirring fin integrally and inwardly protruded from an interior surface of said bottle body.

10. An infant nursing bottle, as recited in claim 9, wherein an exterior surface of said bottle body provides a heat detecting figure printed by a heating detecting paint which changes color at a predetermined temperature.

11. An infant nursing bottle, as recited in claim 8, furthering comprising a stirring fin which comprises a protruding bar integrally protruded from a bottle base of said bottle body.

12. An infant nursing bottle, as recited in claim 11, wherein an exterior surface of said bottle body provides a heat detecting figure printed by a heating detecting paint which changes color at a predetermined temperature.

* * * * *